US006145417A

United States Patent [19]

Bates et al.

[11] Patent Number: 6,145,417

[45] Date of Patent: Nov. 14, 2000

[54] CONVERTIBLE PLIER TOOL

[75] Inventors: Darryle E. Bates, Cuyahoga Falls; Scott Kalanish, Hiram, both of Ohio

[73] Assignee: Stride Tool, Inc., Ellicottville, N.Y.

[21] Appl. No.: 09/213,559

[22] Filed: Dec. 17, 1998

[51] Int. Cl.[7] ..... B25B 7/04

[52] U.S. Cl. ..... 81/387; 81/177.4; 81/302; 81/415

[58] Field of Search ..... 81/385–387, 302, 81/392, 415, 416, 177.4, 427.5, 490; 29/229, 223, 268

[56] References Cited

U.S. PATENT DOCUMENTS

| | | | |
|---|---|---|---|
| 1,122,165 | 12/1914 | Schoening . | |
| 2,483,383 | 9/1949 | Heimann et al. | 81/5.1 |
| 2,546,616 | 3/1951 | Schaaff | 29/229 |
| 3,132,550 | 5/1964 | Sion | 81/302 |
| 3,619,890 | 11/1971 | Kubokawa | 29/229 |
| 3,662,449 | 5/1972 | Hashimoto | 29/229 |
| 4,280,265 | 7/1981 | Murphy | 29/229 |
| 4,476,750 | 10/1984 | Murphy | 81/300 |
| 4,625,379 | 12/1986 | Anderson | 29/229 |
| 4,793,224 | 12/1988 | Huang | 81/302 |
| 5,007,313 | 4/1991 | Jeromson, Jr. et al. | 81/486 |
| 5,174,177 | 12/1992 | Jeromson, Jr. et al. | 81/486 |
| 5,327,802 | 7/1994 | Yu | 81/312 |
| 5,515,587 | 5/1996 | Pool | 29/229 |
| 5,613,413 | 3/1997 | Huang | 81/490 |
| 5,664,274 | 9/1997 | Collins | 7/129 |
| 5,675,866 | 10/1997 | Tseng | 16/110.5 |
| 5,809,853 | 9/1998 | Hudson | 81/427.5 |

*Primary Examiner*—Stephen F. Gerrity
*Assistant Examiner*—David B. Thomas
*Attorney, Agent, or Firm*—Watts Hoffmann Fisher & Heinke Co LPA

[57] ABSTRACT

A plier for inserting and removing retaining rings and other purposes. The plier is convertible for alternately closing and opening of the jaws as the handles are closed. The handles and jaws are rotatable about a pivot shaft. Cams effect movement of the key members between a first position wherein a first key member connects a first handle to a first jaw and a second key member connects a second handle to a first jaw whereby the jaws move inwardly as the handles move inwardly and a second position wherein the first key member connects the first handle to the second jaw and the second key member connects the second handle to the first jaw whereby the jaws move outwardly as the handles are moved inwardly. The plier includes a storage cavity for tips and tip change tools.

24 Claims, 12 Drawing Sheets

CONVERTIBLE PLIER TOOL

FIELD OF INVENTION

The present invention relates generally to plier tools such as retaining or snap ring pliers. More particularly, the present invention relates to pliers of a type which are convertible between a first position which allows the jaws to move inwardly as the handles are moved inwardly and a second position which allows the jaws to move outwardly as the handles are moved inwardly.

Retaining rings are utilized in annular grooves on shafts and ends of shafts to retain bearings, collars, and the like on the shaft. Referring to FIG. 1, a retaining ring 30 extends circumferentially between a pair of ends which are formed to have hubs 32. The hubs 32 have apertures 34 in which are inserted tips of a plier tool and force applied to either spread the hubs to expand the ring, as illustrated at 36, or squeeze the hubs to contract the ring, as illustrated at 38, as necessary for installing the ring in and removing the ring from either external or internal grooves.

It is thus sometimes considered desirable to squeeze (move inwardly) the handles to effect movement of the jaws outwardly to expand the ring. It is at other time considered desirable to squeeze the handles to effect movement of the jaws inwardly to contract the ring. Thus, it is considered desirable to provide a plier which is convertible between an external and an internal tool. U.S. Pat. Nos. 4,280,265 and 4,476,750 disclose a pair of retaining ring pliers which utilize a pair of separate coplanar jaws and a pair of separate handles arranged about a common fixed pivot point having a pair of fulcrum points adapted to be changed to alternately engage one handle then another to change the fulcrum point to permit the changing of the tool from external to internal tool. Two fulcrum pins are disposed in the jaws and adapted to alternately engage each set of handles to shift the fulcrum point from a position adapted to move the jaws inwardly as the handles are moved inwardly to a position where the jaws are moved outwardly as the handles are moved inwardly. This patent discloses an alternative embodiment which has overlapping jaws about a common pivot, and the handles are moved relatively to the jaws such that the fulcrum point is shifted to an opposite side of the pivot by movement of the handles. A thumb nut is loosened in order to so shift the handles.

It may be difficult for the user of the pliers of the above patents to slide the pins into position. It may also be awkward and time-consuming for the user to loosen the thumb nut, shift the handles, and re-tighten the thumb nut.

It is accordingly an object of the present invention to provide a plier which is easily and quickly convertible between an internal and an external tool.

It is another object of the present invention to provide such a plier which is rugged and has low production cost.

It is a further object of the present invention to provide convenient access to tips and tip change tools.

In order to provide such a convertible tool, in accordance with the present invention, a keyway is provided in the hub portion of each jaw and a corresponding keyway is provided in a corresponding coplanar portion of the opposite jaw, and a key member connected to each handle is movable between the keyways for the respective handle to alternately engage the handle to one and then the other of the jaws to quickly and easily convert the tool between an internal and an external tool. Preferably, cam means is provided for effecting movement of first and second key members between a first position wherein the first key member connects a first handle to a first jaw and the second key member connects a second handle to a second jaw whereby the jaws move inwardly as the handles are moved inwardly and a second position wherein the first key member connects the first handle to the second jaw and the second key member connects the second handle to the first jaw whereby the jaws move outwardly as the handles are moved inwardly.

The above and other objects, features, and advantages of the present invention will be apparent in the following detailed description of a preferred embodiment thereof when read in conjunction with the accompanying drawings wherein the same reference numerals denote the same or similar parts throughout the several views.

DETAILED DESCRIPTION OF THE PREFERRED EMBODIMENT

Figure 1:
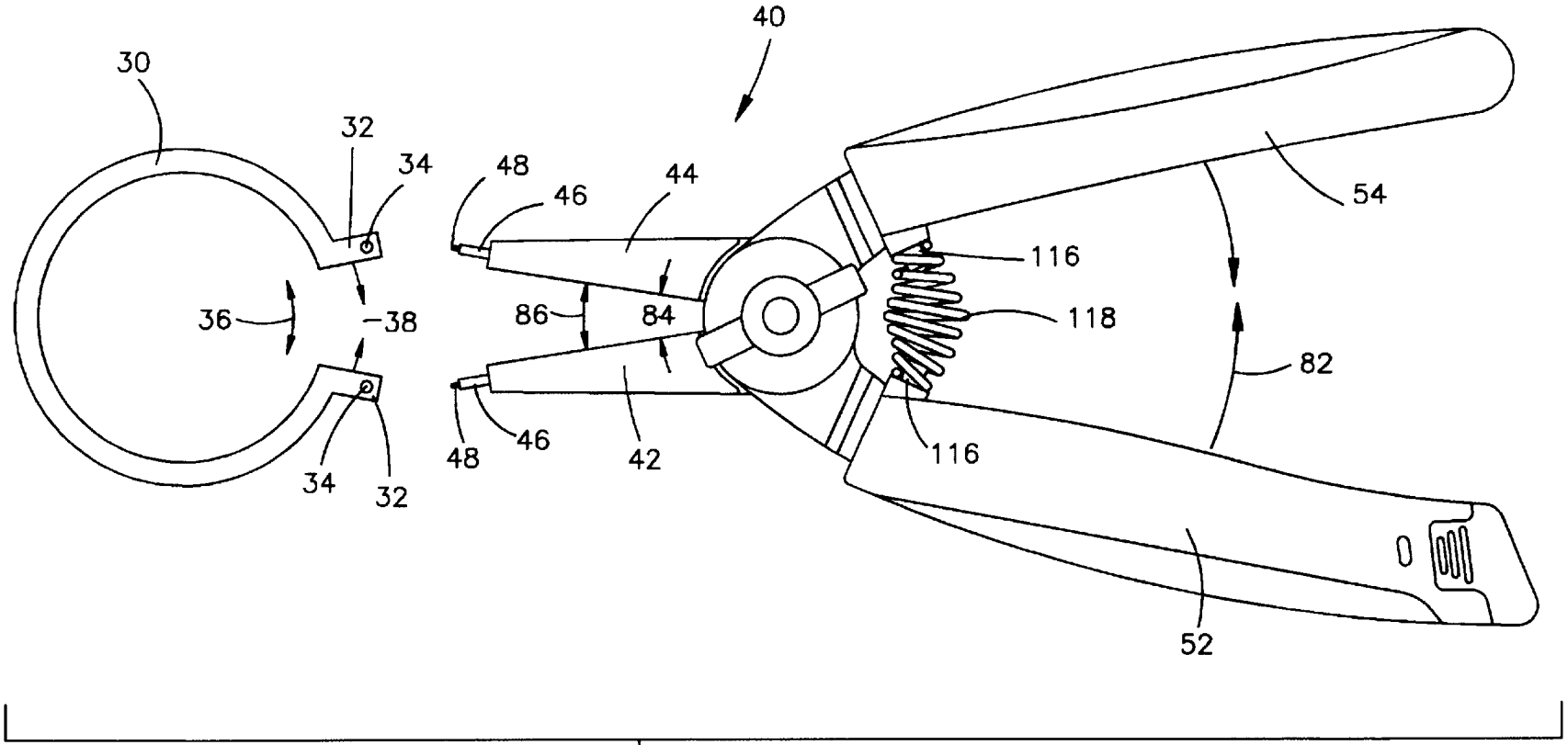
FIG. 1 is a perspective view of a retaining ring plier which embodies the present invention and illustrating a retaining ring on which the plier is usable.

Referring to the drawings, there is shown generally at 40 a plier tool used for inserting and removing the retaining ring 30. The plier 40 has a pair of left and right jaws 42 and 44 respectively from the forward ends of which extend a pair of tips 46 respectively. The tips 46 end in reduced diameter portions 48 respectively which are insertable in the retaining ring apertures 34 respectively. The jaws 42 and 44 are openable (tips moved further apart) and closeable (tips moved closer together), as described hereinafter, to spread and contract, as illustrated at 36 and 38 respectively, the ring 30 for inserting the ring in and removing the ring from a retaining ring groove.

Figure 2:
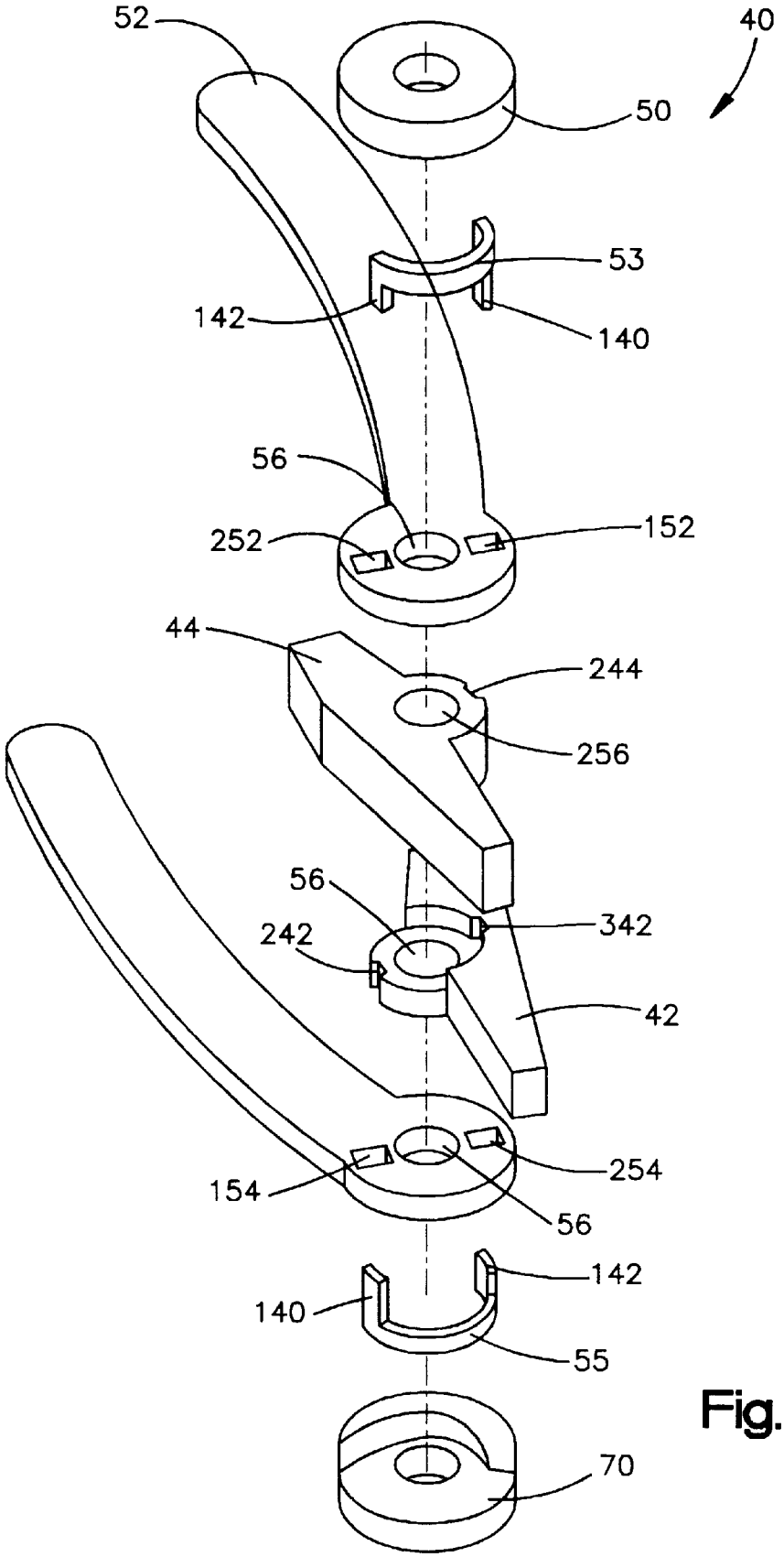
FIG. 2 is a schematic perspective exploded view of the major parts of a plier which embodies the present invention.
Figure 3:
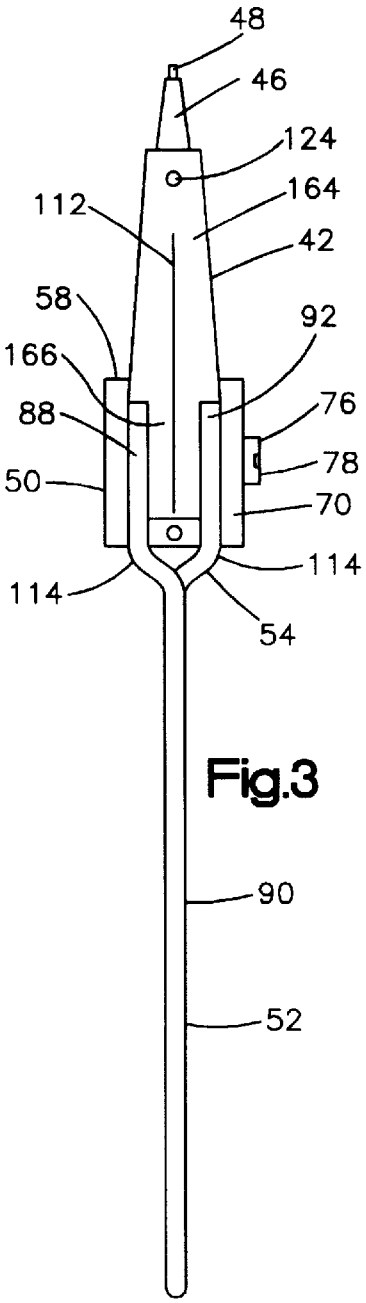
FIG. 3 is a side elevation view thereof.

FIGS. 4 to 28 show individual components of a preferred embodiment of the tool 40. FIGS. 1 to 3 are provided to aid in understanding the principles of the invention, and similar parts are given the same reference numeral to aid in understanding the relation of the parts in the preferred embodiment of FIGS. 4 to 28 by reference to the assemblies illustrated in FIGS. 1 to 3.

The tool 40 also includes a pair of left and right handles 52 (FIGS. 19 to 22) and 54 (FIGS. 23 to 25 and FIGS. 27 and 28) respectively for attaching to the jaws 42 and 44 (FIGS. 14 to 18) with one handle attached to one jaw and the other handle attached to the other jaw for opening and closing the jaws, as described hereinafter.

Referring to FIG. 2, each of the jaws and handles has an aperture 56. The tool 40 includes a member 50 (FIGS. 4 and 5) which has a generally circumferential cap portion 58 from which extends, centrally thereof, a generally cylindrical neck portion 60 (FIG. 5). In the tool assembly, the neck portion 60 is received in each of the apertures 56 and thus serves as an axis of rotation for the jaws and handles. As used herein and in the claims, the terms "radial" and "axial" and variations respectively thereof are meant to refer to directions normal to and parallel to the neck portion 60 respectively.

In FIG. 5, the neck portion 60 has a distal end portion 62 which is notched to provide a pair of diametrically-opposed shoulders 64 providing a generally rectangular shape to the end portion 62 in section for mounting a generally cylindrical cap member 70 (FIGS. 10 to 13). The cap member 70 has a centrally disposed aperture, illustrated at 72, extending therethrough. The aperture 72 is shaped similarly as the shape of end portion 62 for receiving end portion 62 so that relative rotational movement between members 50 and 70 is prevented. The diameter of the remainder of the neck portion 60 is sized to be too large to be received within aperture 72 whereby the shoulders 64 engage and locate the cap member 70. Unlike as shown in FIG. 3, a circular counterbore, illustrated at 74, is provided in the outer surface of member 70 for receiving the head 76 (FIG. 3) of a screw 78 with the screw shank extending through aperture 72. The screw 78 threadedly engages a threaded aperture, illustrated at 80 (FIG. 5), in the neck portion 60 so that the members 50 (FIG. 5) and 70 (FIG. 10) are tightly connected together with the jaws and handles rotatably received on the neck portion 60 between the cap portion 58 and the cap member 70. The neck portion 60 thus acts as a pivot for rotatable movement of the jaws and handles.

Referring to FIG. 2, the left handle 52 is connectible to either of the jaws 42 and 44, and the right handle 54 is connectible to either of the jaws 42 and 44 to make the plier tool 40 convertible between an internal retaining ring tool (wherein the jaws move toward each other, as illustrated at 84 in FIG. 1, to compress the retaining ring 30 for its removal from or insertion in an internal groove when the handles are closed or moved toward each other, as illustrated at 82 in FIG. 1) and an external retaining ring tool (wherein the jaws move apart, as illustrated at 86 in FIG. 1, to expand the retaining ring 30 for its removal from or insertion in an external groove when the handles are closed). Thus, the left handle 52 is connectible to the left jaw 42 and the right handle 54 is connectible to the right jaw 44 to convert the tool 40 to an external retaining ring tool, and, alternately, the left handle 52 is connectible to the right jaw 44 and the right handle 54 is connectible to the left jaw 42 to convert the tool 40 to an internal retaining ring tool.

Figure 19:
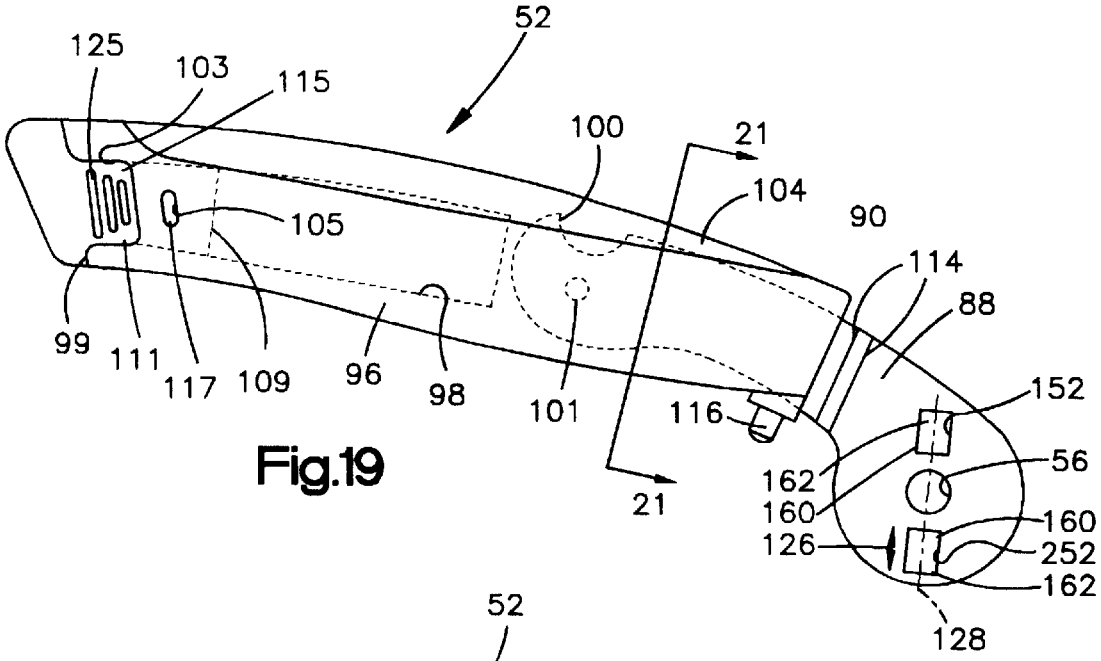
FIG. 19 is a plan view of one handle therefor.
Figure 20:
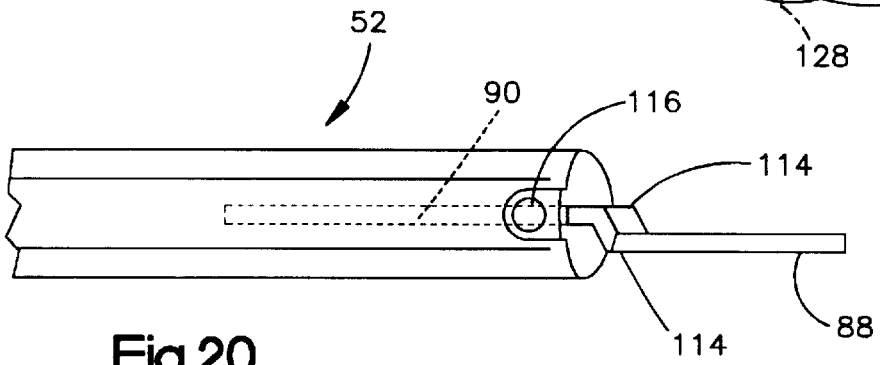
FIG. 20 is a partial side view of the handle.

Referring to FIGS. 19–25 and 27–28, each handle 52 and 54 may be composed of, for example, 1050 steel suitably heat treated and having a thickness of, for example, about 0.093 inch and covered with plastic material as hereinafter described in FIG. 19. Handle 52 has a pivot portion 88, containing the respective aperture 56, and a gripping portion 90. Likewise and referring to FIG. 23, handle 54 has a pivot portion 92, containing the respective aperture 56, and a gripping portion 94. Returning to FIG. 19, gripping portion 90 is encased in a rigid plastic material 96 which is molded thereto and extends beyond the rear end of the gripping portion 90. The rear end portion of the plastic material 96 thus has sufficient hardness to receive the handle load. A preferred plastic material 96 is glass filled nylon. An indent, illustrated at 100, in the outer edge of the portion 90, near the rear thereof, and an aperture, illustrated at 101, in the rear end portion thereof, are provided to receive the plastic material to lock the plastic cover 96 to the gripping portion 90 against slippage off the gripping portion.

Figure 21:
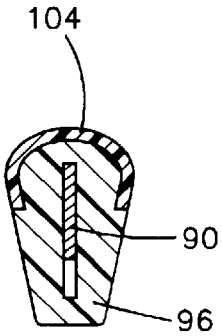
FIG. 21 is a sectional view thereof taken along lines 21—21 of FIG. 19.
Figure 22:
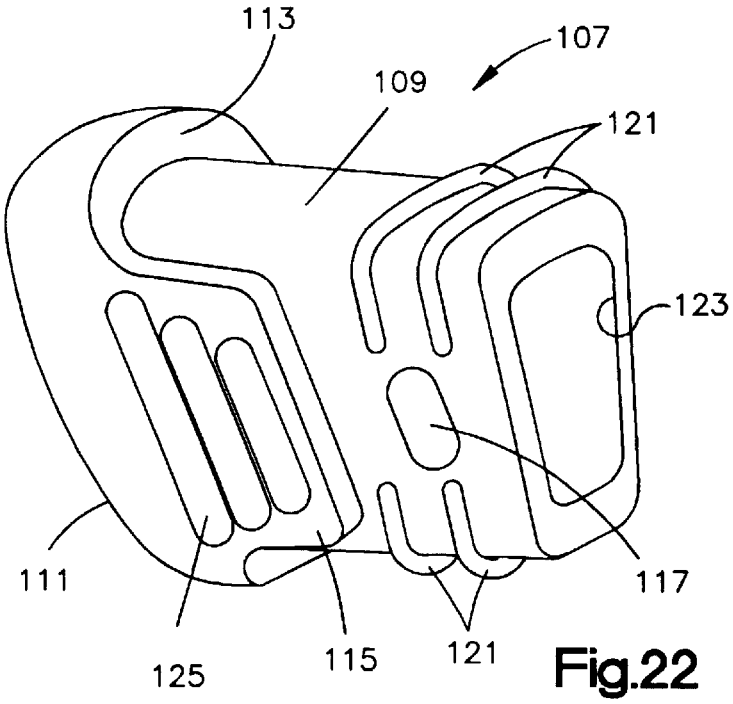
FIG. 22 is a perspective view of a plug for closing a tool cavity in the handle.

The outer edge of the plastic cover 96 is covered over substantially its length by a layer 104 of soft thermoplastic elastomeric material to cushion the force applied by one's hand as the handles are squeezed together. The soft elastomer layer 104 extends for a short distance from the outer edge along the upper and lower sides, as shown in FIG. 21.

Figure 23:
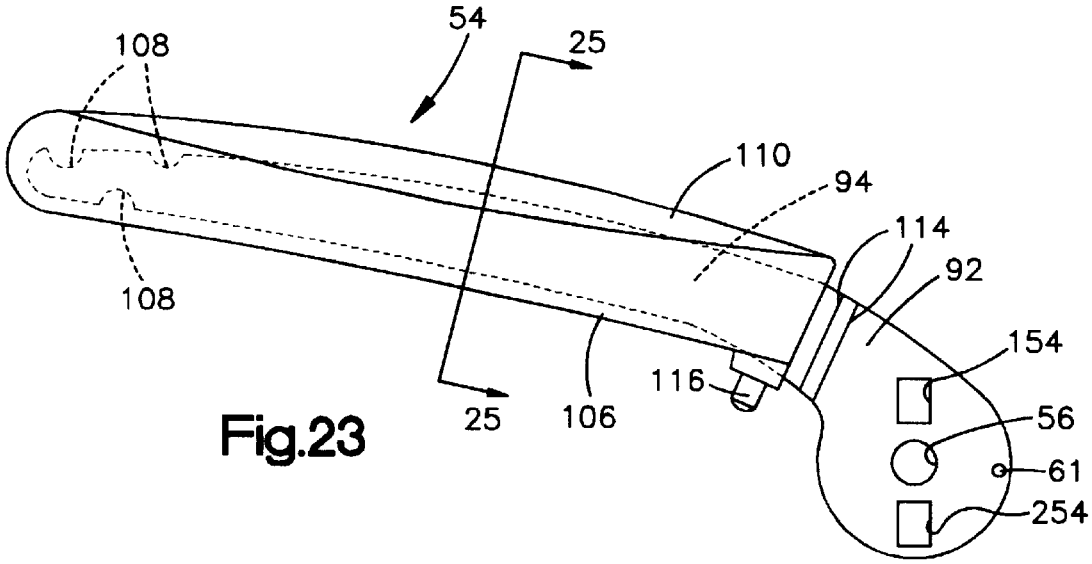
FIG. 23 is a plan view of the other handle therefor.
Figure 24:
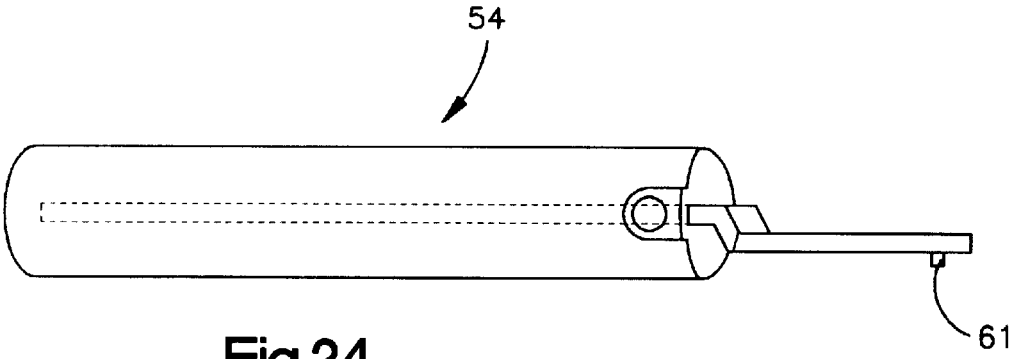
FIG. 24 is a side view of the other handle.
Figure 25:
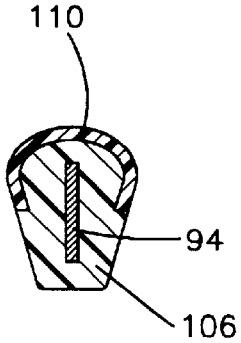
FIG. 25 is a sectional view thereof taken along lines 25—25 of FIG. 23.
Figure 27:
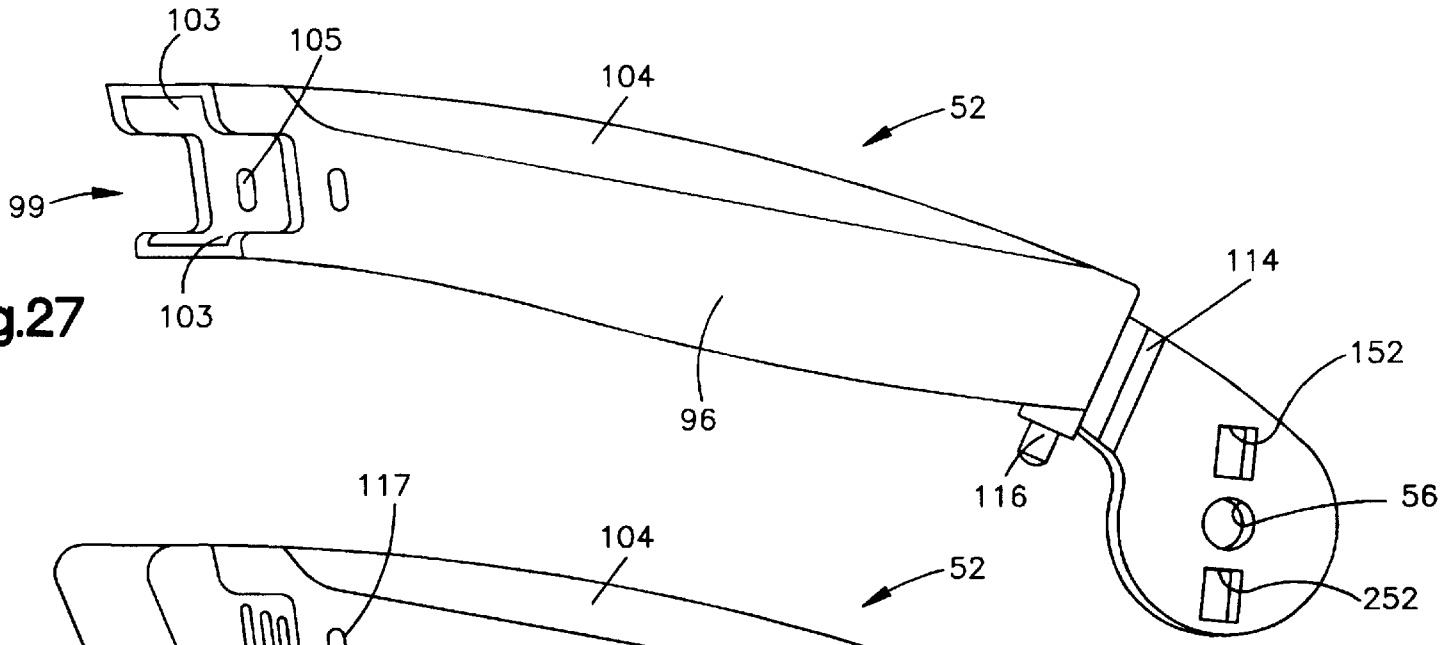
FIG. 27 is a perspective view of the handle of FIG. 19 without the plug.
Figure 28:
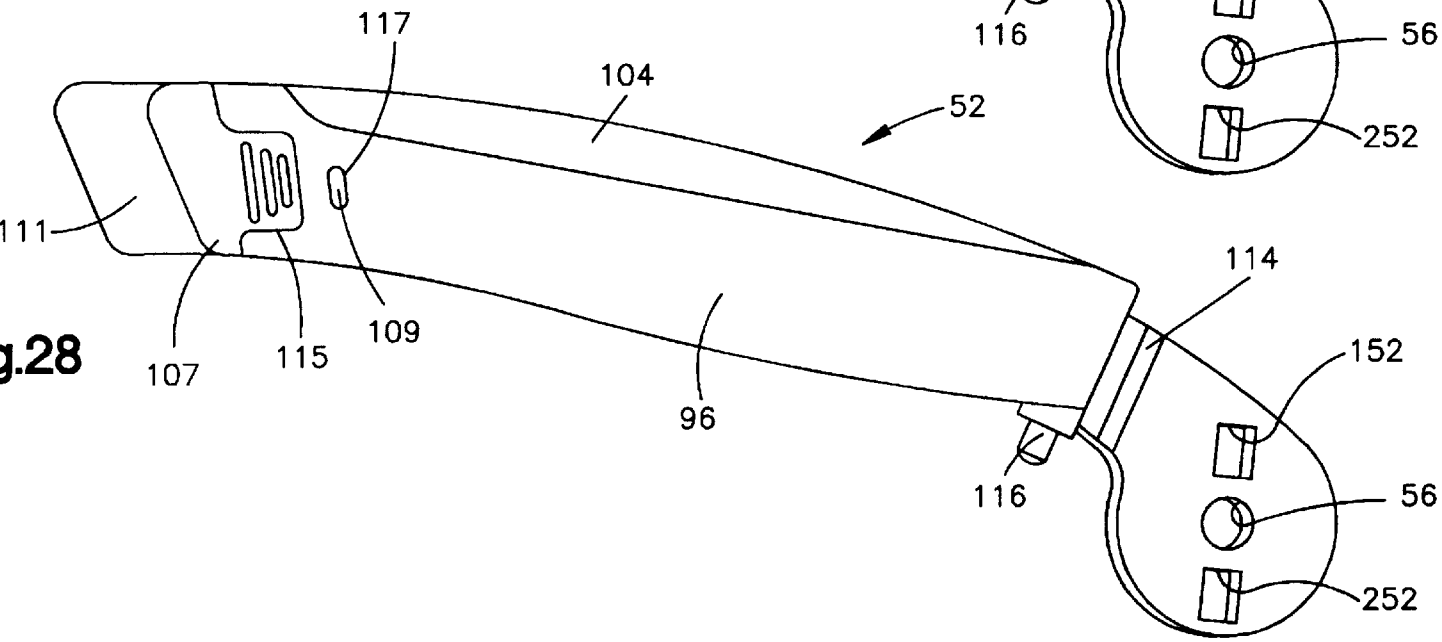
FIG. 28 is a perspective view of the handle of FIG. 19 with the plug.

In FIG. 23, gripping portion 94 of the other handle 54 is encased in a rigid plastic material 106 which is molded thereto and which is similar to material 96. Unlike handle 52, the gripping portion 94 of handle 54 extends substantially through the full length of the plastic cover 106. Indents, illustrated at 108, in the inner and outer edges of gripping portion 94, near the rear thereof, are provided to lock the plastic cover 106 to the gripping portion 94 against slippage off the gripping portion 94. The outer edge of the plastic cover is covered over substantially its length by a layer 110 of soft thermoplastic elastomer to cushion the force of the grip as the handles are squeezed together. The soft elastomer layer 110 extends for a short distance from the outer edge along the upper and lower sides of the handle portion 94, as shown in FIG. 25.

As illustrated in FIG. 3, the pivot portions 88 and 92 are parallel to each other and are spaced on opposite sides of a central plane, illustrated at 112. Handles 52 and 54 are each bent or otherwise suitably formed, at bends illustrated at 114, so that the handle portions 90 and 94 are coplanar along central plane 112.

Referring to FIGS. 19 and 23, the rigid plastic covers 96 and 106 are each molded or otherwise suitably formed to have a cylindrical projection 116 on its inner edge and near the forward end thereof. The ends of a spring 118 are suitably mounted on the projections 116 respectively. The spring 118 is provided to bias the handles 52 and 54 to open (the handles spread apart).

Figure 18:
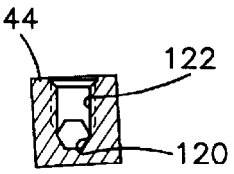
FIG. 18 is a sectional view thereof taken along lines 18—18 of FIG. 14.
Figure 16:
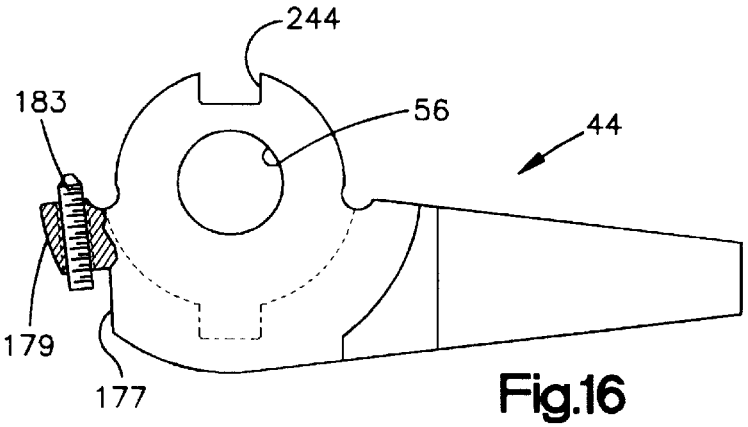
FIG. 16 is a bottom view, partly in section, of the jaw.

In FIGS. 14–18, the tips 46 are partially received in passages 120 in the forward ends of the jaws respectively and cantileverly support portions 48 (FIG. 1) forwardly of the jaws. The tips 46 are secured in passages 120 respectively by suitable means such as a threaded aperture, illustrated at 122, in the outer jaw edge and extending into passage 120. A set screw 124 is threadedly received in each aperture 122 to bear against the respective tip 46 to tightly secure the tips in the jaws. The passage 120 is hexagon-shaped in cross-section, as shown in FIG. 18, to receive the respective tip 46, which is similarly shaped in cross-section so that proper alignment of the tip is achieved and so that rotation of the tip in the passage is prevented.

In order to provide for convenient access to tips and tip change tools, in accordance with the present invention, the portion of the plastic material 96 which extends beyond the gripping portion 90 of handle 52 is hollowed, i.e., it has a square channel or void, illustrated at 98 in FIG. 19, therein, to provide storage space for the tips and tip change tools. The channel 98 opens out the rear end of the plastic material, as illustrated at 99. The rear end of the plastic material 96 has notches, illustrated at 103, in its sides. Forwardly of the notches 103 are generally rectangular rounded holes or apertures, illustrated at 105, which extend entirely through the sides of the plastic material 96. The opening 99 is closable by a plug 107 (FIG. 22), which is composed of a soft thermoplastic elastomer, which may be similar to the material of which layer 104 is composed. Plug 107 has an inner portion 109 and an outer or cap portion 111. The cap portion 111 has a pair of extensions 115 which are shaped to conform to the shapes of the notches. The cap portion 111 overhangs the inner portion 109 to provide a perimetric shoulder, illustrated at 113, which engages the rear edge of the rigid plastic 96 so that the outer sides of the plug 107 and of the rigid plastic 96 are pleasingly flush. The plug 107 is press fit within the cavity 98 and has a pair of ridges 117 on opposite sides of the inner portion 109 to be receivable in the holes 105 respectively for securing the plug 107 in position. Additional ridges 121 are provided on the inner portion 109 for providing a tight sealed fit. The inner portion 109 over the entirety of its length (i.e., including the portion thereof on which the extensions 115 lie) is hollowed to provide a cavity, illustrated at 123. Grips in the form of ridges 125 are provided on each of the extensions 115. In order to remove the plug 107 so that tips or tip change tools may be removed from the storage cavity 98 or replaced therein, the extensions 115 are gripped and squeezed to cave the inner portion 109 of the plug 107 inwardly so that the ridges 117 are removed from the holes 105, and the plug 107 is then pulled from the cavity 98. By gripping and squeezing the extensions 115, the plug 107 may be reinserted in the cavity 98 and the ridges 117 reinserted in the holes 105 when the extensions 115 are released. It should be understood that the cavity 98 may be closed by other suitable closures, for example, threaded cap, hinged cap, which other enclosures are meant to come within the scope of the present invention.

In FIG. 19, handle 52 has a pair of slots 152 and 252 on diametrically opposed sides of its aperture 56 and which extend entirely through the thickness of the handle. These slots 152 and 252 are elongate in the radial direction, i.e., in a direction toward or away from the center of aperture 56. The length, illustrated at 126, of each of these slots 152 and 252 may, for example, be about 9/32 inch. Thus, the slots 152 and 252 have a common longitudinal centerline, illustrated at 128, which passes through the center of corresponding aperture 56. Turning to FIG. 23, handle 54 has a pair of slots 154 and 254 which are similarly sized and arranged as slots 152 and 252.

Referring to FIGS. 6–9, a pair of slides or key members 53 and 55, which may be composed, for example, of Catamold 5620 tool steel or other suitable material, are carried by the handles 52 and 54 respectively. Each of these slider members 53 and 55 has a flat generally oblong body portion 130 which has centrally thereof a generally oblong aperture, illustrated at 132, which extends therethrough. Aperture 132 has a minor diameter, illustrated at 134, which is slightly larger than the diameter of neck portion 60 (FIG. 5), and a longer major diameter, illustrated at 136. Aperture 132 may, for example, be formed of a pair of semi-circular end walls joined by straight walls.

The sliders or keys 53 and 55 are received adjacent the handles 52 and 54 respectively with the neck portion 60 received in the oblong apertures 132. For example, the neck portion 60 may have a diameter, illustrated at 138 in FIG. 5, of about 0.32 inch, and the minor and major diameters 134 and 136 respectively may be about 0.32 inch and 0.516 inch respectively. This allows movement of the sliders 53 and 55 back and forth along a direction of the major diameter 136 but not along a direction of the minor diameter 134.

Each slider or key member 53 and 55 is formed to have a relatively long or key leg 140 and a relatively short or stabilizing leg 142 on diametrically opposite (relative to the major axis 136) ends thereof and extending from the same side of the body portion 130 in a direction normal to the body portion 130. For example, the body portion 130 may have a thickness, illustrated at 144, of about 0.058 inch, and legs 140 and 142 may have lengths, illustrated at 146 and 148 respectively, of about 0.188 inch and 0.088 inch respectively. The short or stabilizing leg length 148 is slightly less than the thickness of, for example, about 0.093 inch of its corresponding handle. The stabilizing legs 142 are received in and ride within slots 252 and 254 respectively to thus stabilize the bearing of the respective sliders within the tool.

The long legs 140 extend beyond the respective handles for reasons which will become apparent. The width, illustrated at 150, of each of the legs 140 and 142 of, for example, about 0.104 inch is less than half the lengths 126 of, for example, about 9/16 inch of the slots in which the legs 140 and 142 are movable thus allowing positioning of each of the sliders 53 and 55, and more particularly the long legs 140 thereof, in first and second positions wherein the long legs are alternately at opposite ends of their respective slots, i.e., an inner end and an outer end, illustrated at 160 and 162 respectively.

Returning to FIGS. 14–18, the jaw 44, which may be made, for example, of P/M FN-020813OHT with 57 HRC heat treatment or other suitable material, has a portion 164 which contains the tip 46 and a reduced thickness attachment portion 166 which contains the aperture 56. As shown in FIG. 3, both sides of portion 166 are recessed from the respective sides of portion 164 for receiving the respective handle portions 88 and 92 so that their outer surfaces are flush with the sides of tip portion 164.

Figure 14:
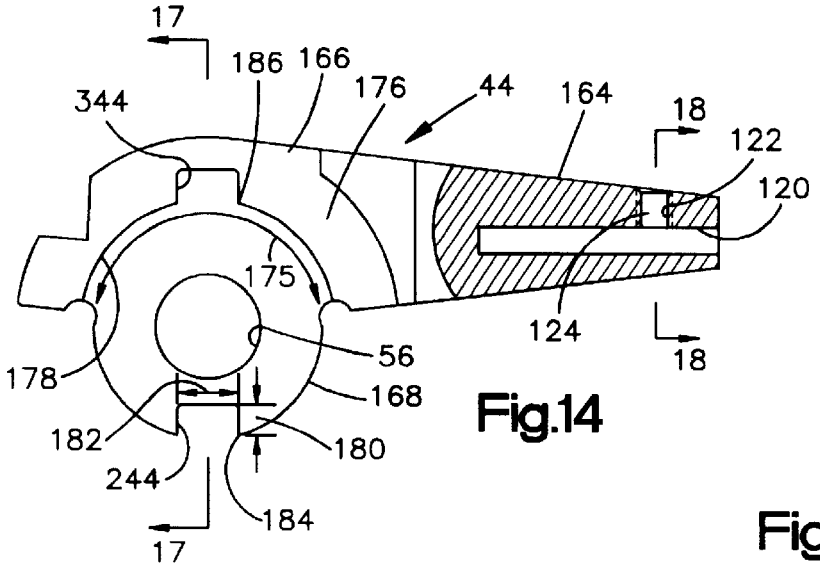
FIG. 14 is an enlarged plan view, partly in section, of one of the jaws therefor, the other jaw being identical thereto except where otherwise noted.
Figure 17:
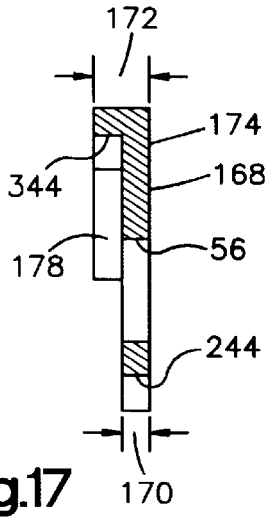
FIG. 17 is a sectional view thereof taken along lines 17—17 of FIG. 14.
Figure 15:
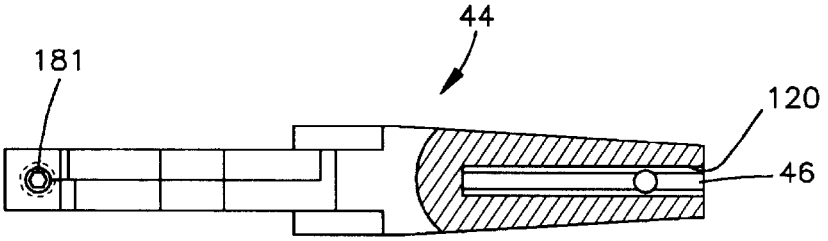
FIG. 15 is a side elevation view, partly in section, thereof.
Figure 36:
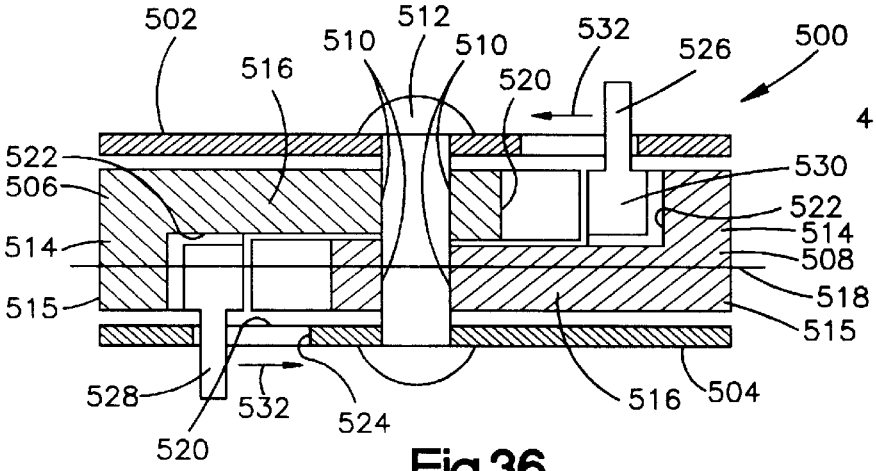
FIG. 36 is a partial sectional view of a tool in accordance with another alternative embodiment of the present invention.

Attachment portion or hub 166 contains a generally half-moon shaped portion 176 and further contains a reduced thickness portion 168 which has a thickness, illustrated at 170, which is about half of the thickness, illustrated at 172, of portion 166. Reduced thickness portion 168 shares a common side, illustrated at 174 in FIG. 17, with portion 166 whereby, in the assembled tool, the half-moon portions 176 occupy diametrically opposite sides of the aperture 56. A half-moon portion 176 on one jaw is coplanar with a reduced thickness portion 168 on the other jaw so that the hubs may be said to overlap each other in the axial direction. By the term ""coplanar-, as used in this specification and the claims, is meant "'lying in a common radial plane (a plane to which the neck portion 60 or pivot means is normal)-. Thus, FIG. 14 is a view taken in a radial plane. The plane illustrated at 518 in FIG. 36 is also a radial plane.

The boundary between the half-moon portion 176 and the reduced thickness portion 168 is defined by an arcuate wall 178. Half-moon portion 176 extends over an arc, illustrated at 175, of less than 180 degrees so that the half-moon portions of both jaws together extend over an angle of less than 360 degrees to thereby allow movement of the jaws pivotally relative to each other. For example, angle 175 may be about 167.5 degrees thereby allowing jaw movement through about 25 degrees.

One of the jaws, i.e., jaw 44, has a notch 177 (FIG. 16) in the outer surface of its half-moon portion 176 opposite portion 164 and defining a portion 179 which contains a threaded aperture 181 (FIG. 15) in which is threadedly received a set screw 183 (FIG. 16) for engaging the half-moon portion of the other jaw 42 in order to provide adjustment for an opening position stop which will allow jaw rotation less than as afforded by angle 175 and to thereby prevent damage to small external rings.

In FIG. 14, Jaw 44 contains a pair of notches or keyways 244 and 344 which are on diametrically-opposed sides of the respective aperture 56 for receiving one of the long or key legs 140 as hereinafter described. Jaw 42, which is similar to jaw 44 except as otherwise described herein, contains a similar pair of notches or keyways 242 and 342. Keyway notches 242 and 244 are in the edges of the hub portions 168 respectively and extend entirely through the thicknesses thereof, and keyway notches 342 and 344 are in the semicircular walls and extend over the entire heights thereof. The keyways 244 and 344 are coplanar, i.e., they share a common radial plane. Each of the keyways 244 and 344 is sized cross-sectionally to receive the entire cross-sectional area of the key legs 140. For example, each of the keyways 244 and 344 may have a length and width, illustrated at 180 and 182 respectively, of about 1/8 inch and 3/16 inch. The outer boundary, illustrated at 184, of keyway 244 coincides with the inner boundary, illustrated at 186, of keyway 344 so that keyways 242 and 244 are radially (with respect to the corresponding aperture 56) inwardly of keyways 342 and 344 respectively. In this embodiment, each keyway is shown to provide for engagement of its jaw to only one handle. When the jaws 42 and 44 are assembled in the tool, there will be a first pair of keyways 244 and 342 alignable with each other on one side of the axle portion 60 and a second pair of keyways 242 and 344 alignable with each other on the diametrically opposed side of the axle portion 60. The first pair of keyways are alternately engageable by the key leg 140 of slider or key 53 by the sliding of the key 53 in a direction of its major diameter 136, i.e., normal to the pivot shaft 60, so that the key leg engages either keyway 244 or keyway 342 into connect the handle 52 to either jaw 44 or jaw 42 respectively. The second pair of keyways are alternately engageable by the key leg 140 of the other key 55 by the sliding of the key 55 in a direction of its major diameter 136, i.e., normal to the pivot shaft 60, so that the key leg engages either keyway 242 or keyway 344 to connect the other handle 54 to either jaw 44 or jaw 42 respectively.

Figure 4:
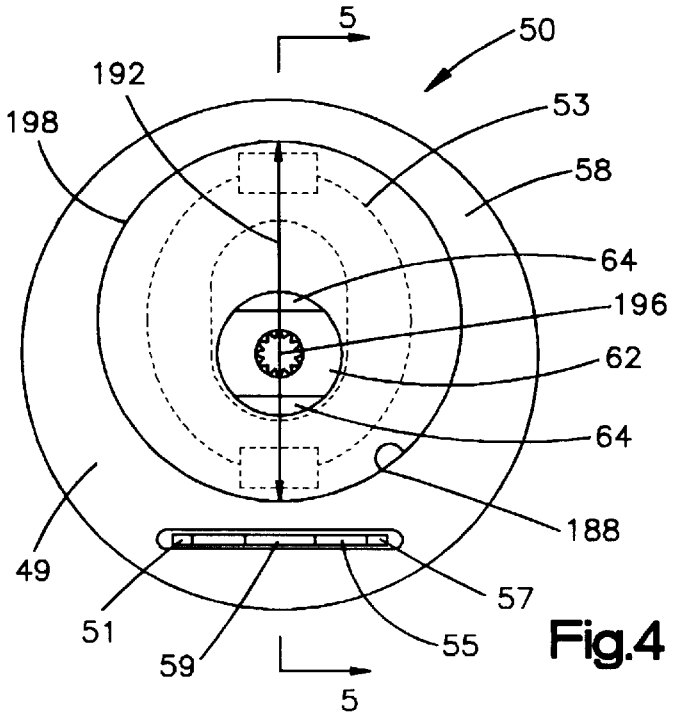
FIG. 4 is an enlarged plan view of a combined cam and axle therefor (and an associated spring received in a groove thereof) and illustrating schematically in phantom lines one of the key members in position therewith.
Figure 5:
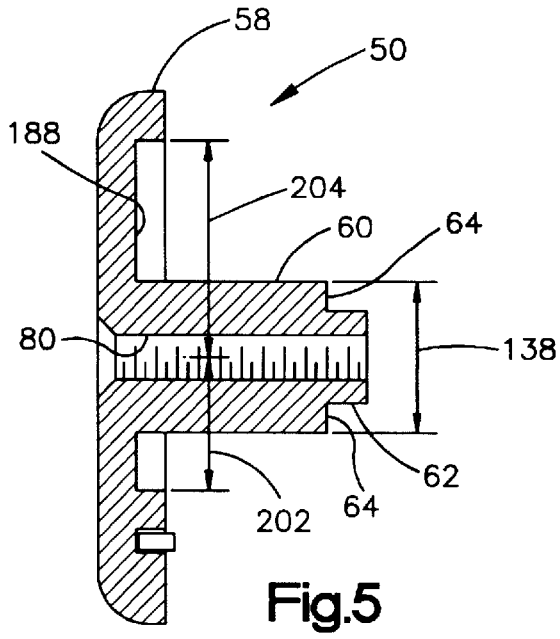
FIG. 5 is a sectional view thereof taken along lines 5—5 of FIG. 4.
Figure 26:
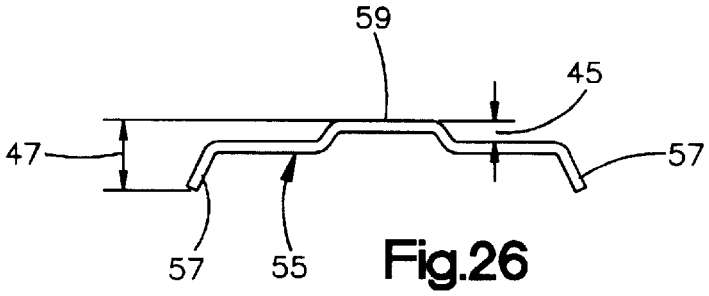
FIG. 26 is a longitudinal edge view of the spring received in a groove of the cam of FIG. 4.
Figure 6:
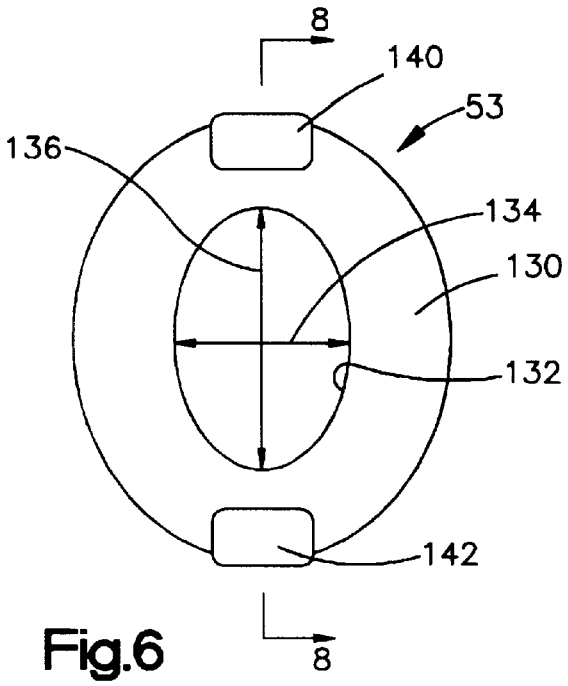
FIG. 6 is an enlarged plan view of the key member, the other key member being identical thereto.
Figure 7:
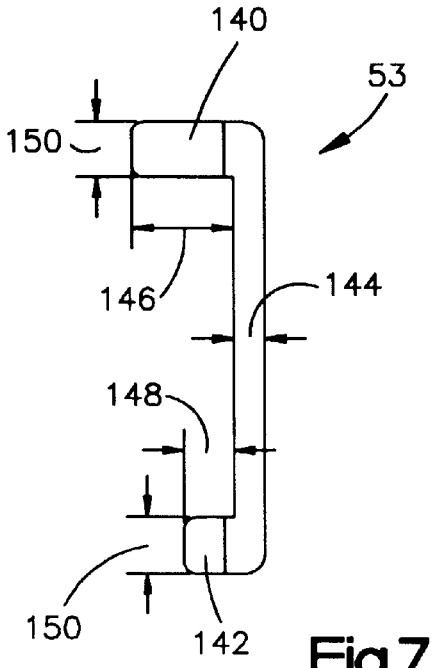
FIG. 7 is a side elevation view of the key member.
Figure 8:
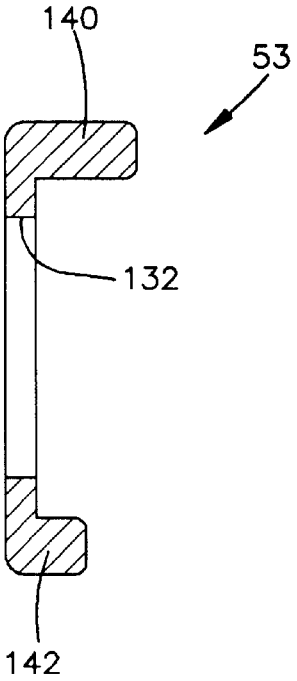
FIG. 8 is a sectional view thereof taken along lines 8—8 of FIG. 6.
Figure 9:
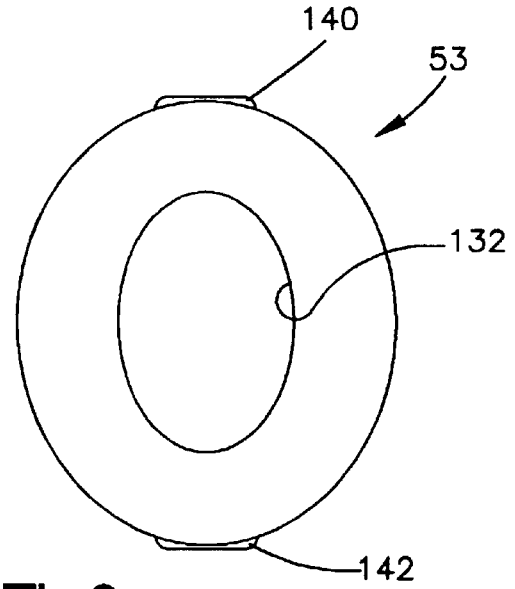
FIG. 9 is a bottom view of the key member.
Figure 10:
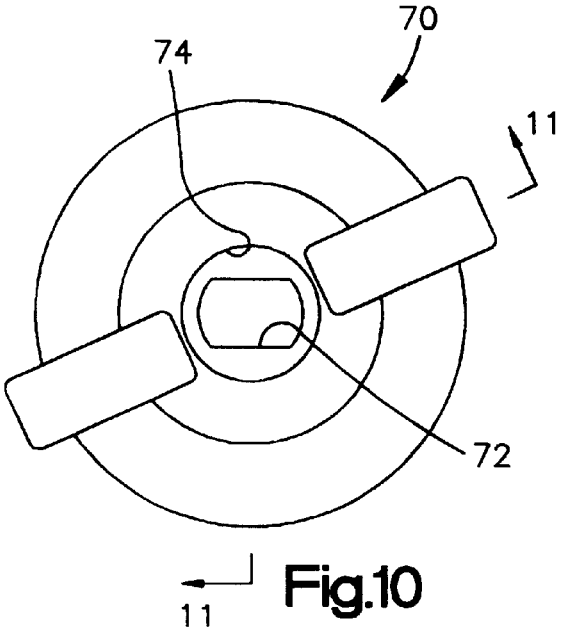
FIG. 10 is an enlarged plan view of the other cam member therefor.
Figure 11:
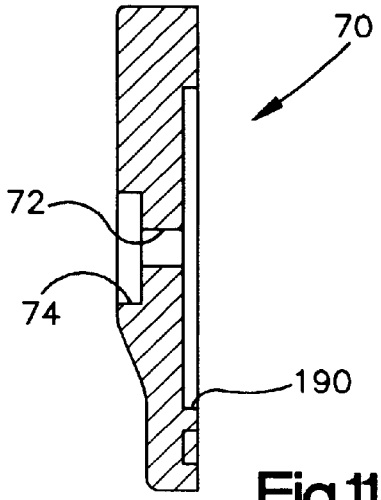
FIG. 11 is a sectional view thereof taken along lines 11—11 of FIG. 10.
Figure 12:
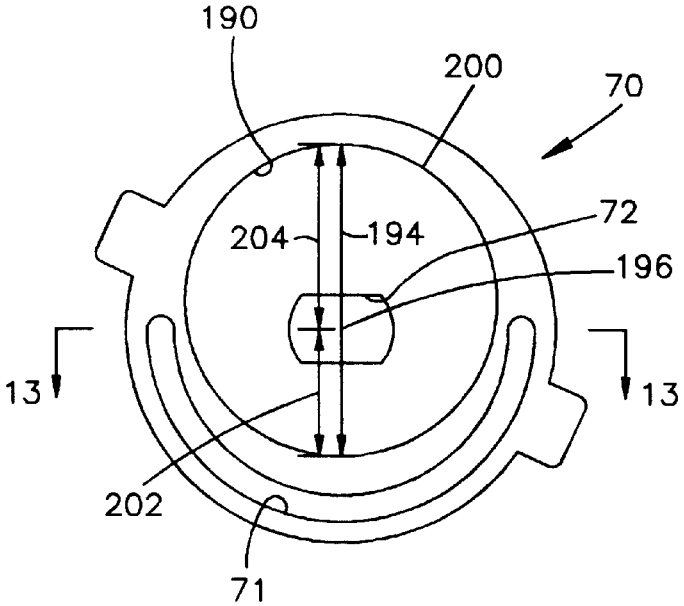
FIG. 12 is a bottom view of the other cam member.
Figure 13:
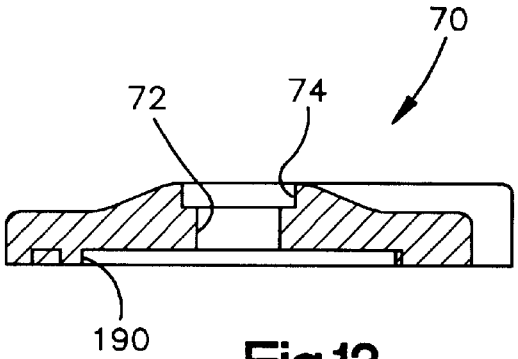
FIG. 13 is a sectional view thereof taken along lines 13—13 of FIG. 12.

Turning to FIGS. 4 and 5, Cap member 50, which has portion 60 serving as the center of rotation thereof as well as the center of rotation of cap member 70, has a recess, illustrated at 188, in its inner side for receiving the key 53 so that the key leg 140 thereof is received in handle opening 152 for engaging one of the first pairs of keyways. Similarly, cap member 70 has a recess, illustrated at 190, in its inner side for receiving the key 55 so that the key leg 140 thereof is received in handle opening 154 for engaging one of the second pair of keyways. The engagement of the key legs 140 of the keys 53 and 55 in the respective pairs of keyways restrains rotational movement thereof so that the keys 53 and 55 are only movable radially in a direction of their respective major diameter 136. The rectangular shapes of the axle end portion 62 and of the corresponding aperture 72 locate the orientations of the recesses 188 and 190 relative to the directions along which the respective keys 53 and 55 are required to move. These directions of movement for key 53 within recess 188 and for key 55 within recess 190 are illustrated at 192 and 194 in FIGS. 4 and 12 respectively. The center of the diameter of recess 188 along direction 192 is offset from the axis of rotation, illustrated at 196, of cap member 50 so that the wall 198 of recess 188 acts as a cam or eccentric for mating with the key 53 and moving the key leg 140 thereof radially inwardly and outwardly along the direction 192. Similarly, the center of the diameter of recess 190 along direction 194 is offset from the axis 196 of rotation of cap member 70 so that the wall 200 of recess 190 also acts as a cam or eccentric for mating with the key 55 and moving the key leg 140 thereof radially inwardly and outwardly along the direction 194. Thus, for example, along directions 192 and 194, the distances, illustrated at 202 and 204, from the rotational axis 196 to either of the walls 198 and 200 on opposite sides of axis 196 are about 3/8 inch and 17/32 inch respectively. When the connected cap members or knobs 50 and 70 are rotated, each cam wall drives the respective key out of a keyway of one jaw and into a keyway of the other jaw. Since the connected cap members 50 and 70 must be rotated together, they are thus oriented to be rotated to cam key 53 along direction 192 inwardly toward the axis 196 to engage keyway 244 to connect handle 52 to jaw 44 while the key 55 is simultaneously cammed along direction 194 also inwardly toward axis 196 to engage keyway 242 to connect handle 54 to jaw 42 to convert the tool to an external retaining ring tool wherein the jaws move away from each other when the handles are closed to expand the retaining ring for its removal from or insertion in an external groove. When it is desired to convert the tool back to an internal retaining ring tool wherein the jaws move toward each other when the handles are closed to compress the retaining ring for its removal from or insertion in an internal groove, the cap members 50 and 70 are rotated 180 degrees to cam key 53 along direction 192 outwardly away from axis 196 to disengage keyway 244 and engage keyway 342 to disconnect handle 52 from jaw 44 and connect it to jaw 42 and to simultaneously cam key 55 along direction 194 also outwardly away from axis 196 to disengage keyway 242 and engage keyway 344 to disconnect handle 54 from jaw 42 and to connect it to jaw 44.

At 51 (FIG. 4) is a straight groove in the inner surface of cap portion 58. A flat spring, illustrated at 55 in FIG. 26, which may be composed of spring steel having a thickness of, for example, 0.016 inch or other suitable material, is press fit within the groove 51. The spring 55 has a pair of downwardly bent end portions 57 which engage the groove floor and a raised central portion 59. For example, when the spring 55 is relaxed, the distances 45 and 47 may be about 0.034 and 0.089 inch respectively. The spring 55 is biased so that the central portion is raised above the inner surface 49 of the cam portion 58 to alternately engage slots 152 and 252 during cam rotation whereby, when so engaged, additional force is required to override the spring 55. Thus, the spring 55 acts as a position lock during cam rotation at the internal and external tool positions respectively.

At 71 (FIG. 12) is a semi-circular groove in the inner surface of cap member 70. Handle member 54 has a ball plunger 61 (set screw with spring loaded ball) protruding therefrom for engaging groove 71 and, in conjunction with the spring 55, prevent over-rotation during rotation of the cap members 50 and 70 for converting the tool. Alternatively, a set screw or extruded semi-piece may be provided instead of the ball plunger, and the bottom of the groove 71 may have indents 73 at the ends thereof, i.e., spaced 180 degrees apart, for engagement lockingly by the set screw at either of the selected positions so that the tool remains in the selected position and, in conjunction with the spring 55, prevent over-rotation. The sliding surfaces of the tool may be lightly lubricated to ease movement therebetween.

Figure 31:
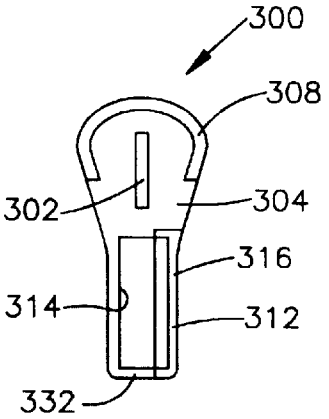
FIG. 31 is a sectional view thereof taken along lines 31—31 of FIG. 29.
Figure 32:
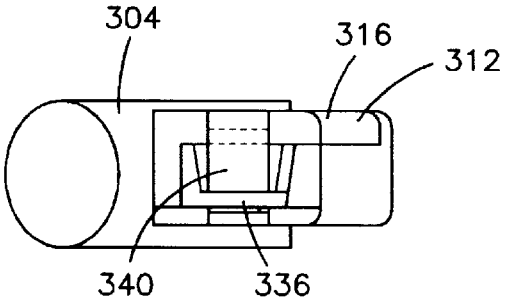
FIG. 32 is an end view thereof taken along lines 32—32 of FIG. 29.

Referring to FIGS. 29 to 32, there is illustrated generally at 300 an alternative embodiment of the handle 52 which, similar to handle 52, includes a pivot portion 88 containing aperture 56 and slots 152 and 252 and is similarly bent as illustrated at 114. Handle 300 includes a gripping portion 302 which, like gripping portion 94 of handle 54, extends substantially through the full length of a cover 304 of rigid plastic material (which is similar to material 96) molded thereto and in which it is encased. Indents, illustrated at 306, in the inner and outer edges of gripping portion 302, near the rear thereof, are provided to lock the plastic cover 304 to the gripping portion 302 against slippage of the gripping portion 302. The outer edge of the plastic cover is covered over substantially its length by a layer 308 of soft thermoplastic elastomer similar to the material of which layer 104 is composed, to cushion the force of the grip by one's hand squeezing the handles together. The soft elastomer layer 308 extends over a short distance from the outer edge along the upper and lower sides of the handle portion 302, as seen in FIG. 31. The rigid cover 304 is molded to form a cylindrical projection 310, similar to projection 116, on its inner edge and near the forward end thereof to receive spring 118.

Figure 29:
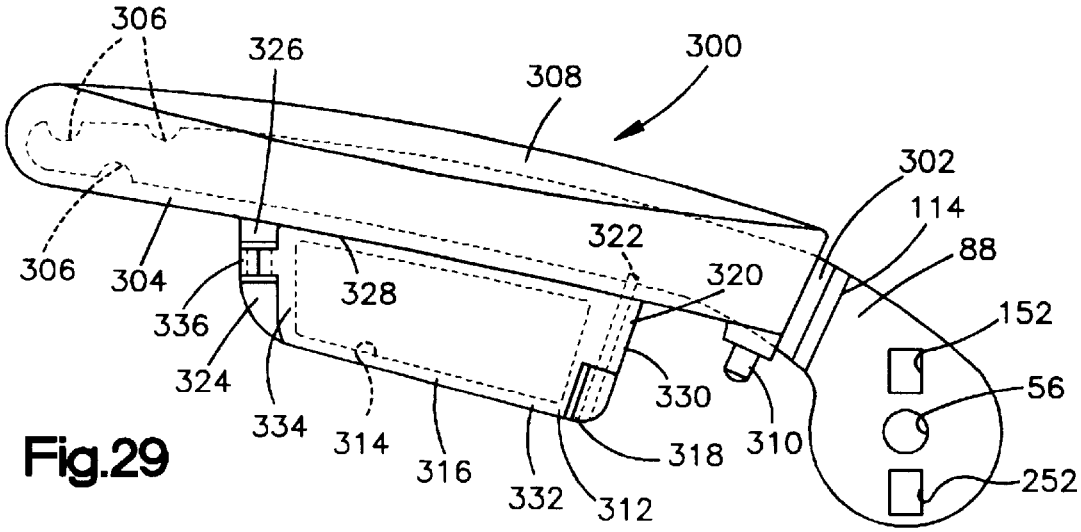
FIG. 29 is a plan view of an alternative embodiment of the handle of FIG. 19.
Figure 30:
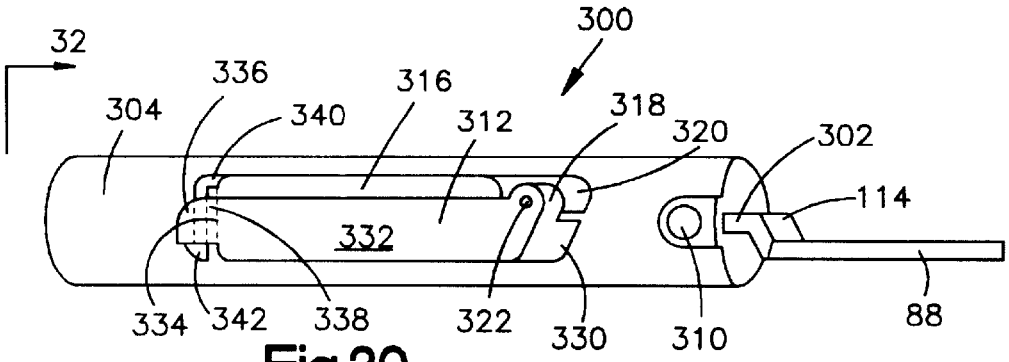
FIG. 30 is a side view of the handle of FIG. 29.

Rigid plastic cover 304 is molded to form an alternative embodiment of the tip and tip change tool storage means. Thus, the rigid plastic cover 304 is molded to form, on its inner side, an appendage or box 312 which is hollow to define a cavity, illustrated at 314, for storage of tips and tip change tools. The cavity has an upper (as seen in FIG. 29) opening which is closable by a lid 316. The forward and inner walls 330 and 332 respectively of the box 312 are formed to have a raised knob 318 which is spaced from the cavity 314 and which is aligned with a knob or hinge portion 320 on the lid 316, and a pin 322, composed of metal or other suitable material, is inserted through apertures in the knobs 318 and 320 and the portion 328 (box outer wall) of rigid plastic material 304 surrounding the handle portion 302 and to which the storage appendage 312 is molded. Thus, the lid 316 is rotatable or swingable about hinge pin 322 for opening and closing thereof. The rear and inner walls 334 and 332 respectively of the box 312 are formed to have a pair of knobs 324 and 326 jutting from the inner wall 332 and the portion 328 respectively and a member 336 extending between the knobs 324 and 326 and defining a space, illustrated at 338, between the inner wall 332 and the member 336. The lid 316 is formed to have a tongue or latch portion 340 which extends rearwardly then downwardly (as seen in the drawings) from the rear edge thereof so that it is spaced from the rear wall 334 and receivable in space 338 for closing the lid 316. The lower end of the latch portion 340 is formed to have a catch 342 for engaging the underside of member 336 for latching the lid 316 closed. The latch portion 340 may be flexed forwardly so that the catch 342 disengages member 336 for opening the lid for removal of tips and tip change tools or replacement thereof. The latch portion 340 is biased to spring rearwardly so that the catch 342 engages the underside of member 336 to latch the lid closed upon swinging the lid to the closed position. It should of course be understood that other suitable means may be provided for tool storage conveniently on the plier tool 40, and such other embodiments are meant to come within the present invention.

Figure 34:
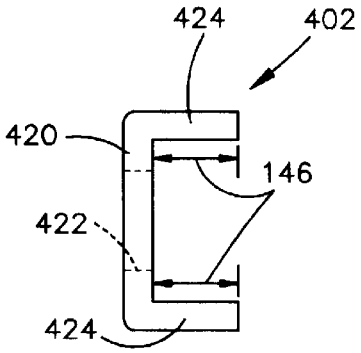
FIG. 34 is a side edge view of a key member for the alternative embodiment of FIG. 33.
Figure 33:
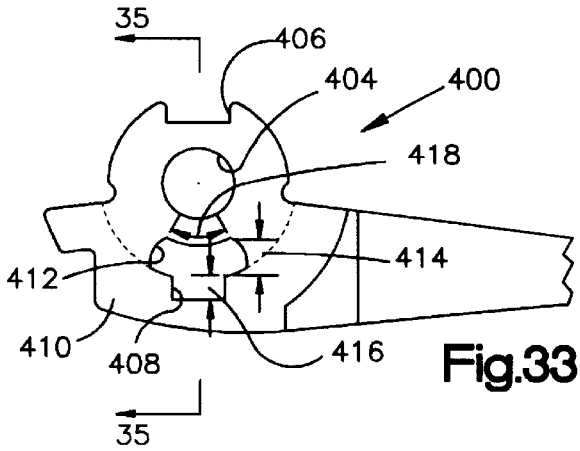
FIG. 33 is a partial plan view of a jaw in accordance with another alternative embodiment of the present invention.
Figure 35:
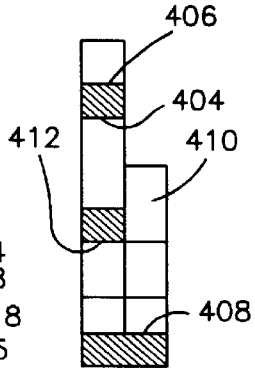
FIG. 35 is an enlarged section view of the jaw of FIG. 33 taken along lines 35—35 of FIG. 33.

Referring to FIGS. 33 to 35, there are illustrated a jaw member 400 and a key member 402 in accordance with an alternative embodiment of a plier tool of the present invention, the plier tool being similar to plier tool 40 except as discussed hereinafter and shown in FIGS. 33 to 35. Similar to jaws 42 and 44, jaw member 400 has an aperture 404 for receiving the neck portion 60 of cam member 50 and supports a tip 46. Jaw 400 also has a keyway notch 406 which is similar to keyway notch 244 for jaw 44. Jaw 400 furthermore has a keyway notch 408 which, similar to keyway notch 344 for jaw 44, is in the semi-circular wall 410 and, unlike keyway notch 344, extends entirely through the thickness of the jaw 400, as seen in FIG. 35. Jaw 400 moreover has a cut-out 412 which also extends entirely through the thickness of the jaw 400 and extends radially inwardly (toward aperture 404) from the semi-circular wall 410 and is adjacent to notch 408 so as to form therewith a single opening which extends entirely through the thickness of the jaw 400. Cut-out 412 has a width, illustrated at 414, which is equal substantially to the width, illustrated at 416, of notch 408 and extends over a arc, illustrated at 418, which is equal at least to 360 degrees less twice the angle 175 (FIG. 14), i.e., for example, at least about 25 degrees.

Key member 402 has a central portion 420 which contains an aperture 422, which is similar to aperture 132. Key member 402 has two legs 424 of substantially equal length 146 each being load carrying for connecting the respective handle 52 or 54 to both jaws alternately. When the key member 402 is moved radially (i.e., relative to the center of aperture 404) to a first position wherein the legs 424 engage keyways 406 and 408 respectively, the handle to which it is attached is connected to the jaw 400 and disconnected from the other jaw. When the key member 402 is moved radially to a second position wherein the legs 424 disengage keyways 406 and 408 respectively, the other jaw is positioned for the legs 424 to engage the similar keyways thereof so that the handle to which it is attached is connected to the other jaw and disconnected from jaw 400. Thus, when in this second position, one of the legs 424 (while positioned to engage keyway 406 of the other jaw) is received in cut-out 412 of jaw 400, which has clearance due to arc length 418 so that the leg moves within the arc length 418 of cut-out 412 and does not therefore undesirably bear against jaw 400. When in the first position, the other leg is received in the corresponding cut-out of the other jaw so that movement of the other jaw is not effected as the legs 424 effect movement of jaw 400.

It should be noted that the keyway 406 in each jaw of the embodiment of FIGS. 33 to 35 may be eliminated (and one of the key member legs 424 shortened so that a key member similar to key member 53 in FIGS. 6 to 9 provided for use therewith) since the slot 408 alone is sufficient for attachment of either handle to the jaw 400. A plier tool with such a pair of jaws 400 having slots 406 eliminated is meant to come within the scope of the present invention.

Figure 38:
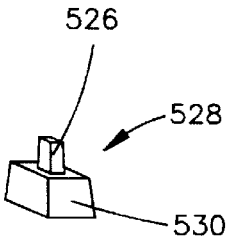
FIG. 38 is a perspective view of a key member for the tool of FIG. 36.
Figure 37:
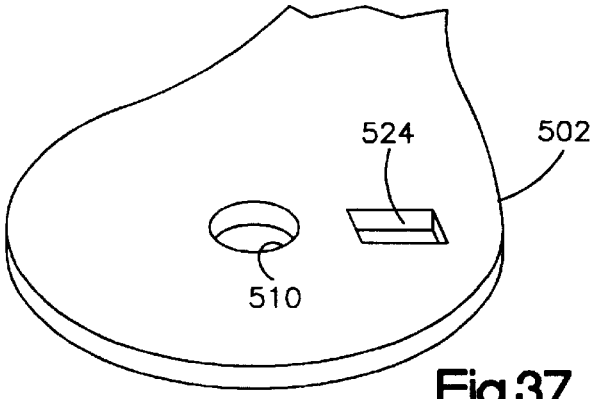
FIG. 37 is a partial perspective view of a handle for the tool of FIG. 36.

Referring to FIGS. 36 to 38, there is illustrated generally at 500 a plier tool in accordance with another alternative embodiment of the present invention. The tool includes a pair of handles 502 and 504 and a pair of jaws 506 and 508 each having an aperture 510 in which is received an axle 512 in the form of a bolt or rivet or other suitable fastener for connecting the handles and jaws together so that they are rotatable about the axle 512. The handles and jaws are similar to handles 52 and 54 and jaws 42 and 44 except as indicated herein.

Each of the jaws 506 and 508 has a hub 515 which includes a hub portion 514 and a reduced thickness hub portion 516 in which its aperture 510 is contained. Hub portion 516 of one jaw is coplanar or lies in a common radial (relative to the pivot means or aperture 510) plane, illustrated at 518, with the hub portion 514 of the other jaw. Thus, the jaw hubs 515 may be said to be overlapping axially.

Each hub portion 516 has a notch or keyway 520, similar to notches 242 and 244, in its edge. Each hub portion 514 has a notch or keyway 522, similar to notches 342 and 344, in the edge of the portion thereof which is coplanar with the reduced thickness portion 516 of the other jaw. Thus, a keyway 520 on one jaw is coplanar with a respective keyway 522 on the other jaw, i.e., they lie in the same radial plane, illustrated at 518 (the pivot means or axle 512 being normal to plane 518, and the plane 518 passing through both keyway 522 in jaw 506 and keyway 520 in jaw 508). It can be seen that a similar radial plane passes through both keyway 520 in jaw 506 and keyway 522 in jaw 508, which are accordingly also coplanar. The jaws are rotatable to a position where these notches or keyways face and are adjacent each other, as seen in FIG. 36. A generally rectangular opening or slot, illustrated at 524, extends entirely through each handle 502 and 504. A handle portion 526 of a key member 528 is receivable in the slot 524 to extend outwardly from the handle 502. The key member also includes a box-shaped key portion 530 which is box-shaped or otherwise suitably shaped to conform to the shapes of the notches or keyways 520 and 522. The length of the opening 524 and its position are such, as can be determined using principles commonly known to those of ordinary skill in the art to which this invention pertains, as to allow the key portion 530 to be moved alternately back and forth between the keyways 520 and 522 with the handle portion 526 received in and moving along the length of opening 524. The handle portion 526 is smaller in length and width than key portion 530 which defines key portion surface 534 which has a greater width than that of opening 524 so that the key portion 530 is trapped under the respective handle 502 and 504 so that the key member 530 is securely held in the tool assembly 500. The keys 528 may be individually manipulated by hand to convert the tool 500 between an internal and an external tool. FIG. 36 illustrates the keys 528 with their portions contained within keyways 522 and thereby connecting handle 502 to jaw 508 and connecting handle 504 to jaw 506 respectively. By moving key portions 526 to the other ends of slots 524 respectively, as illustrated by arrows 532, the key portions 530 are moved from keyways 522 into keyways 520 thereby disconnecting handle 502 from jaw 508 and connecting it to jaw 506 and thereby disconnecting handle 504 from jaw 506 and connecting it to jaw 508. The keys can be returned to the position shown to reconnect the handle 502 to jaw 508 and handle 504 to jaw 506.

Figure 39:
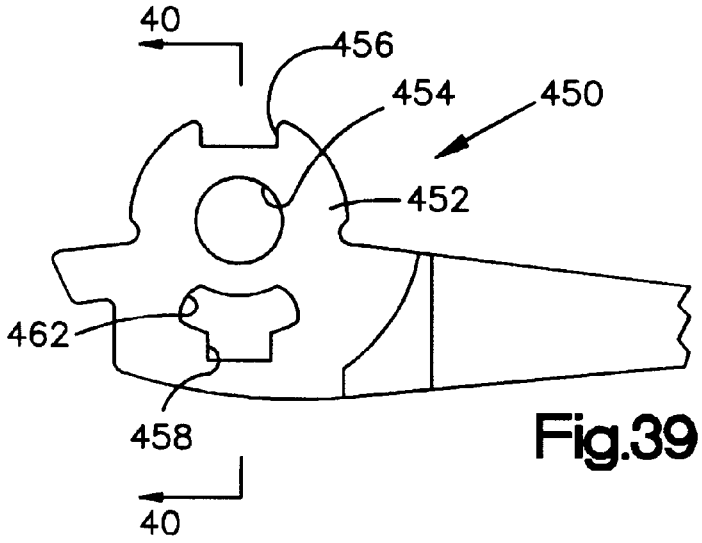
FIG. 39 is a view similar to that of FIG. 33 of another alternative embodiment of the present invention.
Figure 40:
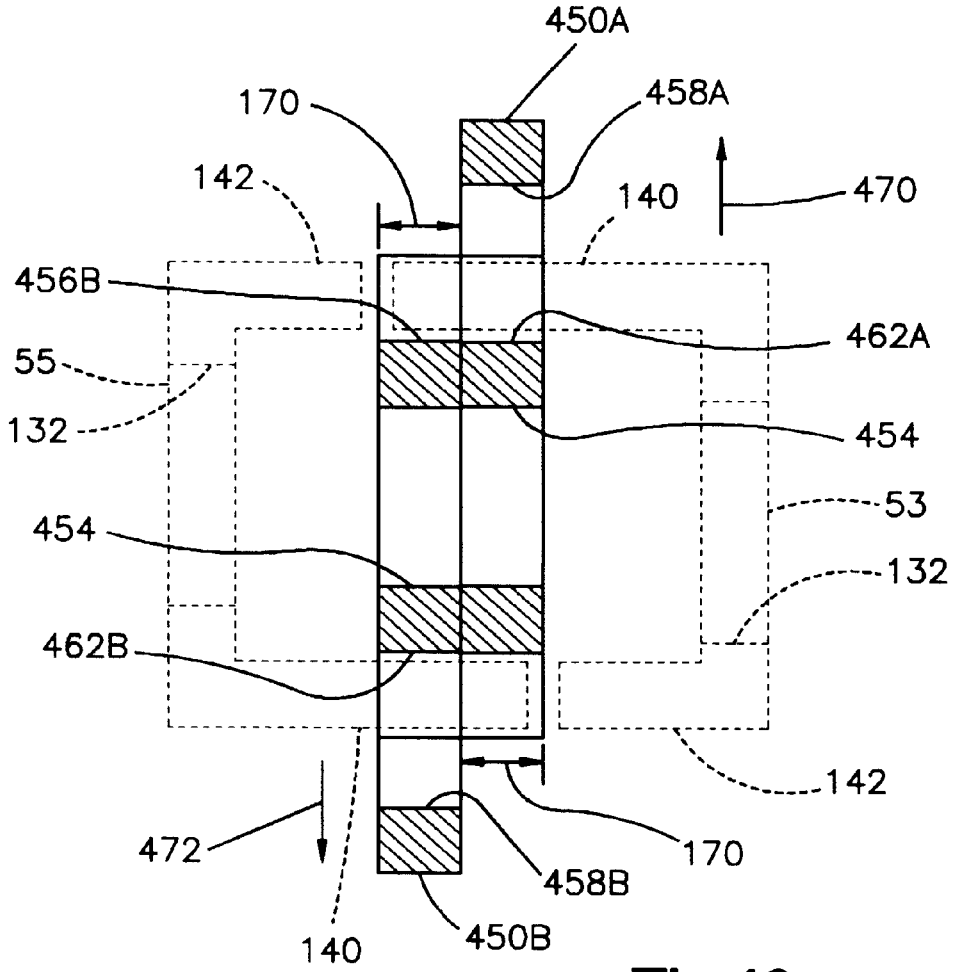
FIG. 40 is an enlarged section view of the jaw of FIG. 39 taken along lines 40—40 of FIG. 39.

The embodiments of the invention so far described have what may be called overlapping hub sections, i.e., portion 176 of the hub of one jaw overlaps axially (i.e., relative to the aperture 56) reduced thickness hub portion 168 of the other jaw so that they both lie in a same radial plane (relative to pivot means or aperture 56). Such overlapping hub portions allow a key member to be moved laterally to alternately engage both jaws. However, it should be understood that it is not required, in accordance with the present invention, that the hub sections so overlap. Referring to FIGS. 39 and 40, there is shown at 450A and 450B two similar jaws for a plier tool wherein each hub portion 452 is of uniform thickness, illustrated at 170 (which is illustrated to be the same thickness as that of reduced thickness hub portion 168), and the jaws accordingly do not have axially overlapping hub portions. The jaws 450 are otherwise similar to jaws 400, including aperture 454 and slots 456, 458, and 462 all similar to aperture 404 and slots 406, 408, and 412. As seen in FIG. 40, key members 53 and 55 (FIGS. 6 to 9) may be used with the jaws 450. The shorter or stabilizing legs 142 are shown not to engage the jaws 450. The longer or load-bearing legs 140 are shown to extend over the thicknesses 170 of both jaws 450A and 450B on diametrically opposite sides of the apertures 454. Key member 53 is shown in a position wherein its leg 140 passes through clearance slot 462A in jaw 450A and is received in slot 456B in jaw 450B to connect its handle to jaw 450B, the clearance slot 462A having sufficient arc length, as previously discussed with respect to the embodiment of FIGS. 33 to 35, that jaw 450A is not engaged by key member 53 during its limited rotational movement about pivot means contained in apertures 454 for opening and closing the jaws 450. Similarly, longer leg 140 of the other key member 55 passes through clearance slot 462B in jaw 450B and is received in slot 456A in jaw 450A to connect its handle to jaw 450A. In order to convert the tool so that the handles are connected to the opposite jaws, the key members are moved radially in the respective directions illustrated by arrows 470 and 472 for key members 53 and 55 respectively whereby the longer leg 140 of key member 53 is removed from slot 456B of jaw 450B and received in slot 458A of jaw 450A for connecting its handle to jaw 450A and whereby the longer leg 140 of key member 55 is removed from slot 456A of jaw 450A and received in slot 458B of jaw 450B for connecting its handle to jaw 450B.

Thus, a plier tool according to the present invention allows convertibility for installing and removing both internal and external retaining rings easily and quickly.

It should be understood that, while the invention has been described in detail herein, the invention can be embodied otherwise without departing from the principles thereof, and such other embodiments are meant to come within the scope of the present invention as defined in the appended claims.

What is claimed is:

1. A plier tool, wherein the cam is responsive to rotation of the pivot for effecting the movement of both of the first and second key members simultaneously.

2. A plier tool according to claim 1 wherein at least one of the key members comprises a central portion capable of receiving the pivot and a leg which extends through a slot in the respective handle for alternately engaging the first keyway on one of the jaws and the second keyway on another of the jaws.

3. A plier tool according to claim 2 further comprising a cam capable of moving the first and second key members between the respective first keyway and the respective second keyway.

4. A plier tool according to claim 2 further comprising: a second leg on the at least one key member, the second leg is shorter than the leg and extends through another slot in the respective handle.

5. A plier tool according to claim 1 including a cam capable moving the first and second key members between the respective first keyway and the respective second keyway.

6. A plier tool comprising first and second jaws, first and second handles, a pivot about which each of said jaws and said handles is rotatable, first and second key members, a cam capable of effecting movement of the first and second key members between a first position wherein the first key member connects the first handle to the first jaw and the second key member connects the second handle to the second jaw whereby the jaws move inwardly as the handles move inwardly and a second position wherein the first key member connects the first handle to the second jaw and the second key member connects the second handle to the first jaw whereby the jaws move outwardly as the handles move inwardly.

7. A plier tool according to claim 6 further comprising means for attaching tips to said jaws respectively for engaging apertures in retaining rings for installing and removing retaining rings.

8. A plier tool according to claim 6 further wherein the cam is responsive to rotation of the pivot for effecting the movement of both of the key members simultaneously.

9. A plier tool according to claim 6 further comprising means for housing tips for the tool and tip change tools.

10. A plier tool according to claim 6 wherein the pivot includes a pair of rotatable end caps, and the cam comprises a recess in said respective end cap and which has a center in a direction of movement of said respective key which is offset from the pivot.

11. A plier tool comprising a pivot having a pair of end caps, first and second jaws rotatable about the pivot and each having an inner hub portion and an increased thickness outer hub portion, the outer hub portions being on diametrically opposed sides of the pivot and extending circumferentially of the pivot over an arc of less than 180 degrees to permit rotation of the jaws through a predetermined arc which is equal to 360 degrees less the combined arc over which the outer hub portions extend, a keyway on each of the inner hub portions and a keyway on each of the outer hub portions, first and second handles rotatable about the pivot and each having at least one passage therethrough, first and second keys having body portions and having leg portions which extend through the handle passages respectively, a cam on each of said end caps and responsive to rotation of the end caps for effecting movement of the keys between a first position wherein the leg portion of the first key engages a keyway on the first jaw to connect the first handle to the first jaw and the leg portion of the second key engages a keyway on the second jaw to connect the second handle to the second jaw and a second position wherein the leg portion of the first key engages a keyway on the second jaw to connect the first handle to the second jaw and the leg portion of the second key engages a keyway on the first jaw to connect the second handle to the first jaw.

12. A plier tool according to claim 11 further comprising tips attached to said jaws respectively for engaging apertures in retaining rings for installing and removing retaining rings.

13. A plier tool according to claim 11 wherein the cam comprises a recess in the respective end cap and which has a center in a direction of movement of the respective key which is offset from the pivot.

14. A plier tool according to claim 13 further comprising means for converting the tool between a first position wherein said jaws move inwardly as said handles move inwardly and a second position wherein said jaws move outwardly as said handles move inwardly.

15. A plier tool according to claim 22 wherein at least one of said handles includes a member to which a respective one of said jaws is attachable and a cover which is composed of a rigid material, and said one handle includes a cover and the cavity is in said cover, the cavity being for receiving tips and tip change tools.

16. A plier tool according to claim 15 wherein the handle includes a lower portion and said cover includes an extending portion which extends beyond a terminal end of said lower portion, said cavity being disposed in said extending portion, and said opening is in a terminal end of said extending portion.

17. A plier tool according to claim 16 wherein said closing means comprises a plug which is press fit in said outlet means and includes ridge means for engaging aperture means in said cover, said plug being hollow so as to be squeezable to remove said knob means from said aperture means and said plug from said outlet means.

18. A plier tool, comprising:

a pivot;

first and second jaws rotatably disposed about the pivot, each of the jaws having a first and a second keyway, the first keyway on each of said jaws being coplanar with the second keyway on a respectively other one of the jaws;

first and second handles rotatably disposed about the pivot;

first and second key members, the first key member being operatively associated with the first handle and capable of moving between the first keyway on the first jaw and the second keyway on the second jaw for connecting the first handle to the first jaw and to the second jaw, respectively, the second key member being operatively associated with the second handle and capable of moving between the first keyway on the second jaw and the second keyway on the first jaw for connecting the second handle to the second jaw and first jaw, respectively;

a cam capable of moving the first and second key members between the respective first keyway and the respective second keyway; and whereby the plier tool is convertible between one wherein the jaws move outwardly as the handles move inwardly and one wherein the jaws move inwardly as the handles move inwardly.

19. A plier tool, comprising:

a pivot;

first and second jaws rotatably disposed about the pivot, each of the jaws having a first and a second keyway, the first keyway on each of said jaws being coplanar with the second keyway on a respectively other one of the jaws;

first and second handles rotatably disposed about the pivot;

first and second key members, the first key member being operatively associated with the first handle and capable of moving between the first keyway on the first jaw and the second keyway on the second jaw for connecting the first handle to the first jaw and to the second jaw, respectively, the second key member being operatively associated with the second handle and capable of moving between the first keyway on the second jaw and the second keyway on the first jaw for connecting the second handle to the second jaw and first jaw, respectively;

the jaws having a first hub portion capable of receiving the pivot and a second hub portion which has a thickness which is greater than that of the first hub portion and which extends about the first hub portion and which extends about the first hub portion over an arc of less than 180 degrees, the second hub portion of each of the jaws being coplanar with the first hub portion of a respectively other of the jaws; and the first and second keyways of each jaw being on diametrically opposed sides of the pivot, the first keyway being in an outer edge of the first hub portion, and the second keyway being in an inner edge of the second hub portion of the jaw and offset radially from the first keyway of the jaw.

20. A plier tool, comprising:

a pivot;

first and second jaws rotatably disposed about the pivot, each of the jaws having a first and a second keyway, the first keyway on each of said jaws being coplanar with the second keyway on a respectively other one of the jaws;

first and second handles rotatably disposed about the pivot;

first and second key members, the first key member being operatively associated with the first handle and capable of moving between the first keyway on the first jaw and the second keyway on the second jaw for connecting the first handle to the first jaw and to the second jaw, respectively, the second key member being operatively associated with the second handle and capable of moving between the first keyway on the second jaw and the key members having an elongate central portion including an elongate aperture for receiving the pivot so that the central portion is movable longitudinally thereof and a pair of legs on opposite sides of the aperture;

each of the jaws having a first hub portion including an aperture for receiving the pivot and further has a second hub portion which has a thickness which is greater than that of the first hub portion and which extends circumferentially about the first hub second keyway on the first jaw for connecting the second handle to the second jaw and first jaw, respectively;

the second hub portion of each of the jaws being coplanar with the first hub portion of a respectively other of the jaws;

a first slot in an outer edge of the first hub portion of each of the jaws, a second slot which extends entirely through an inner edge of the second hub portion of each of the jaws, the first and second slot of each of the jaws being on diagonally opposed sides of the respective pivot;

a third slot which extends entirely through the first hub portion of each of the jaws and defining with the respective second slot a single slot and which extends over an arc circumferentially equal at least to a predetermined combined arc over which the jaws are movable for opening and closing the plier tool;

whereby the legs of each key member are receivable in the first and second slots respectively of one jaw respectively for connecting the one jaw to the third slot of the one jaw respectively for connecting the other jaw to the respective handle and whereby the third slot provides clearance for the respective leg therein so that the one jaw is rotatable while the respective leg is disposed therein; and whereby the plier tool is convertible between one wherein the jaws move outwardly as the handles move inwardly and one wherein the jaws move inwardly as the handles move inwardly.

21. A plier tool comprising a pair of jaw means, means for attaching tips to said jaw means, a pair of handle means, pivot means for rotating said handle means and said jaw means, means for storing tips and tip change tools, at least one of said handle means including a member to which a respective one of said jaw means is attachable and a cover which is composed of a rigid material, said storing means comprising cavity means in said cover for receiving tips and tip change tools, outlet means to said cavity means, means for closing said outlet means, said cover including a portion which extends beyond a terminal end of said member, said cavity means being disposed in said portion, and said outlet means being in a terminal end of said portion, said closing means comprising a plug which is press fit in said outlet means and includes knob means for engaging aperture means in said cover, and said plug being hollow so as to be squeezable to remove said knob means from said aperture means and said plug from said outlet means.

22. A snap ring plier comprising:

a pair of jaws pivotally connected together;

a pair of snap ring engaging tips respectively removably connected to the jaws;

a pair of handles respectively connected to the jaws for causing the jaws and the connected tips to shift to move the connected tips toward and away from one another as the jaws relatively rotate about the pivot in response to operator manipulation of the handles;

one of the handles including a tip storage cavity formed therein;

said one handle further including walls defining a cavity access operating through which spare tips may be inserted into and removed from the cavity; and, a deformable plug insertable into and removable from the opening, the plug when in the opening engaging the handle walls in a plug retaining fit whereby the plug will confine such spare tips to the cavity.

23. The plier tool of claim 22 wherein the walls and the plug include an interacting projection and recess for retaining the plug in the opening, the plug being deformable whereby to enable disconnection of the interaction between the projection and the recess.

24. The plier of claim 22 wherein one of the handles is selectively connectable to one of the jaws and the other handle is selectively connectable to the other of the jaws for manipulation of external snap rings and the one handle is selective connectable to the other jaw and the other handle is selectively connectable to the one jaw for manipulation of internal snap rings.

* * * * *

UNITED STATES PATENT AND TRADEMARK OFFICE

CERTIFICATE OF CORRECTION

PATENT NO. : 6,145,417
DATED : November 14, 2000
INVENTOR(S) : Darryle E. Bates and Scott Kalanish It is certified that error appears in the above-identified patent and that said Letters Patent is hereby corrected as shown below:

Claims,
Please correct claims 1-5, 14 and 15 as follows:

Claim 1,
"A plier tool according to claim 18".

Claim 2,
Delete "1", substitute -- 19 --.

Claim 5,
Delete "1", substitute -- 20 --.

Claim 14,
Delete "13", substitute -- 21 --.

Claim 15,
Delete "22", substitute -- 21 --.

Signed and Sealed this

Twenty-ninth Day of January, 2002

*Attest:*

*Attesting Officer*

JAMES E. ROGAN
*Director of the United States Patent and Trademark Office*